US010961608B2

(12) United States Patent
Iwamoto et al.

(10) Patent No.: US 10,961,608 B2
(45) Date of Patent: Mar. 30, 2021

(54) HEAT-RESISTANT MAGNESIUM ALLOY

(71) Applicant: KURIMOTO, LTD., Osaka (JP)

(72) Inventors: Yuya Iwamoto, Osaka (JP); Yasuhide Kanatsu, Osaka (JP); Akihiko Koshi, Osaka (JP); Jinsun Liao, Osaka (JP)

(73) Assignee: KURIMOTO, LTD., Osaka (JP)

( * ) Notice: Subject to any disclaimer, the term of this patent is extended or adjusted under 35 U.S.C. 154(b) by 39 days.

(21) Appl. No.: 16/085,298

(22) PCT Filed: Mar. 30, 2016

(86) PCT No.: PCT/JP2016/060462
§ 371 (c)(1),
(2) Date: Sep. 14, 2018

(87) PCT Pub. No.: WO2017/168645
PCT Pub. Date: Oct. 5, 2017

(65) Prior Publication Data

US 2019/0062879 A1 Feb. 28, 2019

(51) Int. Cl.
*C22C 23/02* (2006.01)
*C22F 1/06* (2006.01)

(52) U.S. Cl.
CPC ..... *C22C 23/02* (2013.01); *C22F 1/06* (2013.01)

(58) Field of Classification Search
CPC ..... C22C 23/02; C22F 1/06
See application file for complete search history.

(56) References Cited

U.S. PATENT DOCUMENTS

| | | | |
|---|---|---|---|
| 5,811,058 | A | 9/1998 | Baba et al. |
| 2005/0095166 | A1 | 5/2005 | Saikawa |
| 2010/0226812 | A1 | 9/2010 | Kondoh |
| 2013/0280121 | A1 | 10/2013 | Kim et al. |

FOREIGN PATENT DOCUMENTS

| | | | | |
|---|---|---|---|---|
| EP | 1526188 | A2 * | 4/2005 | ..... C22C 23/02 |
| JP | H09-291332 | | 11/1997 | |
| JP | 2002-129272 | | 5/2002 | |
| JP | 2005-068550 | | 3/2005 | |
| JP | 2006-002184 | | 1/2006 | |
| JP | 2007-031789 | | 2/2007 | |
| JP | 2012-126982 | | 7/2012 | |
| JP | 2013-514463 | | 4/2013 | |
| JP | 2014-196525 | | 10/2014 | |

OTHER PUBLICATIONS

International Preliminary Report on Patentability dated Oct. 2. 2018 in International (PCT) Application No. PCT/JP2016/060462 with English translation.
International Search Report dated Jul. 5, 2016 in International (PCT) Application No. PCT/JP2016/060462.

* cited by examiner

*Primary Examiner* — Jessee R Roe
(74) *Attorney, Agent, or Firm* — Wenderoth, Lind & Ponack, L.L.P

(57) ABSTRACT

A magnesium alloy contains, in atomic percent: 5.7 at. % or more and 8.6 at. % or less of Al; 0.6 at. % or more and 1.7 at. % or less of Ca; 0.05 at. % or more and 0.27 at. % or less of Mn; and 0.02 at. % or more and 0.36 at. % or less of a rare earth element (RE); and any one of 0.1 at. % or more and 0.3 at. % or less of Zn and 0.02 at. % or more and 0.18 at. % or less of Sn, wherein the contents in atomic percent satisfy the condition of the inequality of the following Formula (1), and the balance is Mg and inevitable impurities.

$$(Ca+RE)/Al>0.137 \quad (1)$$

4 Claims, 1 Drawing Sheet

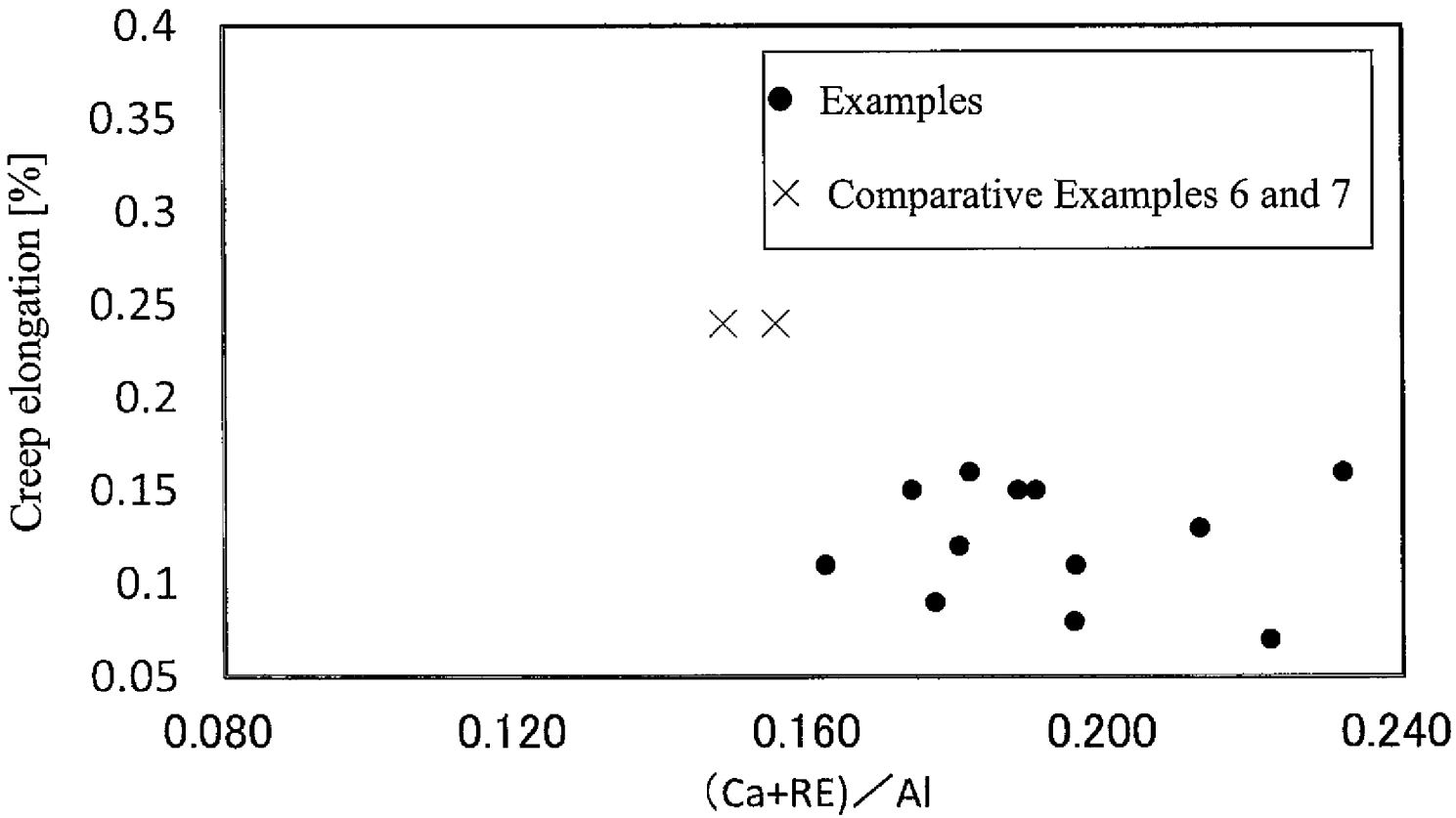
Examples
Comparative Examples 6 and 7
Creep elongation [%]
0.4
0.35
0.3
0.25
0.2
0.15
0.1
0.05
0.080
0.120
0.160
0.200
0.240
(Ca+RE)／Al

HEAT-RESISTANT MAGNESIUM ALLOY

TECHNICAL FIELD

The present invention relates to a magnesium alloy having excellent heat resistance.

BACKGROUND ART

Magnesium alloys obtained by adding an element such as aluminum to magnesium are lightweight, easy to process, and used in various fields. For example, AZ type alloys in which Al, Mn, and Zn are added or AS type alloys in which Al, Mn, and Si are added are known. It is known that high temperature properties are improved by adding Ca, Sn, or RE (rare earth element: misch metal) to these alloys. Particularly for die casting applications, general purpose materials AZ91 excellent in strength at room temperature and AE44 excellent in creep resistance are used.

For example, the following Patent Document 1 describes an alloy in which from 4.5 to 10% by mass (from 4.1 to 9.5 at. %) of Al, from 0.1 to 3% by mass (from 0.06 to 1.9 at. %) of Ca, and from 1 to 3% by mass of RE (misch metal) are added (about from 0.18 to 0.55 at. %), and which has a composition satisfying the following relational expression. Let the content of Al be (a) % by mass, the content of Ca be (b) % by mass, and the content of RE be (c) by mass. Such an alloy crystallizes Al—Ca and Al-RE compounds by addition of Ca and RE, and high temperature strength is improved.

$$1.66+1.33b+0.37c \leq a \leq 2.77+1.33b+0.74c$$

The following Patent Document 2 describes an Mg alloy containing from 4 to 10% by mass (from 3.7 to 9.5 at. %) of Al, from 1 to 3% by mass (from 0.6 to 1.9 at. %) of Ca, from 0.5 to 4% by mass (from 0.2 to 1.6 at. %) of Zn, and less than 3% by mass (about 0.56 at. %) of RE. The creep resistance of such an Mg alloy is improved by the addition of RE.

Further, the following Patent Document 3 describes an Mg alloy containing from 6 to 12% by mass (from 5.5 to 13 at. %) of Al, from 0.05 to 4% by mass (from 0.03 to 2.9 at. %) of Ca, from 0.5 to 4% by mass (from about 0.09 to 0.83 at. %) of RE, from 0.05 to 0.5% by mass (from 0.02 to 0.26 at. %) of Mn, and from 0.1 to 14% by mass (from 0.02 to 3.43 at. %) of Sn. Such an alloy improves the creep resistance by promoting formation of Ca and RE compounds by addition of Sn.

RELATED ART DOCUMENTS

Patent Documents

Patent Document 1: JP H09-291332A
Patent Document 2: JP 2002-129272A
Patent Document 3: JP 2005-68550A

SUMMARY OF THE INVENTION

Problems to be Solved by the Invention

However, the alloy having the composition described in Patent Document 3 tends to have insufficient elongation under normal conditions even though the alloy is excellent in high temperature properties.

In the case of alloys containing Ca, RE and Al, when a preferable range is specified only by the range of each element, there are cases where high temperature properties including creep resistance can be sufficiently exhibited and cases where such an effect is insufficient. This is because the range is not adjustable by simply increasing or decreasing individual values, and it is considered that further conditions must be satisfied in order to obtain an alloy having suitable properties.

A magnesium alloy to which Ca is added improves high temperature properties, but when only physical property values of the high temperature properties are improved, the alloy is not usable for practical applications, and a variety of other mechanical properties are also required to be above certain levels depending on applications.

Accordingly, an object of the present invention is to provide a magnesium alloy excellent not only in high temperature properties but also in mechanical properties as much as possible including elongation in good balance.

Means for Solving the Problems

In the present invention, the above problem is solved by a magnesium alloy containing:

5.7 at. % or more and 8.6 at. % or less of Al; 0.05 at. % or more and 0.27 at. % or less of Mn; 0.6 at. % or more and 1.7 at. % or less of Ca; and 0.02 at. % or more and 0.36 at. % or less of RE; and any one of 0.1 at. % or more and 0.3 at. % or less of Zn and 0.02 at. % or more and 0.18 at. % or less of Sn, wherein the condition of the inequality of the following Formula (1) regarding the number of atoms is satisfied, and the balance is magnesium and inevitable impurities.

$$(Ca+RE)/Al>0.137 \quad (1)$$

It was found that when the condition of the above Formula (1) was satisfied, heat resistance was able to be sufficiently secured, and when this condition was not satisfied, even if the component ratios of the individual elements satisfied the above-described conditions, heat resistance was not able to be sufficiently secured. This is considered to be because both Ca and RE combine with Al to form a heat resistant compound while an $Mg_{17}Al_{12}$ phase having no heat resistance is formed depending on the Al abundance ratio, and therefore, the heat resistance largely changes depending on the abundance ratio and the crystallized form of each compound phase, making it possible to create a situation that is not suitable under the condition of only individual elements.

On the other hand, the content of RE demanded to be high in the above Formula (1) has a strong tendency to lower elongation. Therefore, in order to obtain more preferable mechanical properties in the present invention, RE is preferably 0.15 at. % or less. Since the atomic weight of the rare earth element group constituting RE is extremely large as compared with other elements, in order to estimate the abundance ratio of the compound phase when adjusting the alloy component, it is easy to calculate the abundance ratio by using % (at. %) of atomic percent. Therefore, the concentration of suitable elements of the alloy according to the present invention is indicated by at. %, not wt. %.

The addition of Sn and Zn also indirectly contributes to heat resistance. Since Sn and Zn solid-dissolve in a parent phase preferentially compared with RE, by adding Sn and Zn, it is possible to promote the formation of Al-RE compound excellent in heat resistance. On the other hand, with respect to the effect of Sn and Zn, if both are contained, another compound such as Al—Zn—Ca compound can be formed, and there is a fear that effective improvement of heat resistance may be inhibited. For this reason, what is needed to be contained is either one of Sn and Zn, and the other element needs to be less than the above-described range, preferably below the detection limit.

Effects of the Invention

According to the present invention, a magnesium alloy having excellent mechanical properties at high temperature and normal temperature is provided.

BRIEF DESCRIPTION OF THE DRAWINGS

FIG. 1 is a graph of (Ca+RE)/Al and creep elongation in Examples.

MODE FOR CARRYING OUT THE INVENTION

Hereinafter, the present invention will be described in detail.

The present invention is a magnesium alloy containing at least Al, Mn, Ca, and RE, containing Zn or Sn, and excellent in high temperature properties.

In the magnesium alloy according to the present invention, the content of Al needs to be 5.7 at % or more, and is preferably 6.2 at. % or more. When the content of Al is too small, the strength including the proof stress decreases too much. When the content of Al is 6.2 at. % or more, the balance between mechanical performance in tension and heat resistance is further improved. On the other hand, the content of Al needs to be 8.6 at. % or less, and is preferably 7.5 at. % or less. When the content of Al is too large, heat resistance and elongation tend to be too low. When the content of Al is 7.5 at. % or less, sufficient elongation can be easily ensured.

In the magnesium alloy according to the present invention, the content of Mn needs to be 0.05 at. % or more. This is because Mn has an effect of removing Fe, which is an impurity in a molten metal, by forming an Al—Fe—Mn compound, and suppressing deterioration of corrosion resistance, and when the content of Mn is too small, the ease of corrosion derived from Fe is unignorable. On the other hand, the content of Mn needs to be 0.27 at. % or less, and is preferably 0.20 at. % or less. This is because, when the content of Mn is too large, a lot of the above-described Al—Fe—Mn compound, an intermetallic compound of Mn and Al, and a simple substance Mn are precipitated, whereby the alloy becomes brittle and the toughness tends to be too low. When the content of Mn is 0.20 at. % or less, reduction of the strength can be sufficiently prevented while an effect of removing iron is sufficiently secured.

In the magnesium alloy according to the present invention, the content of Ca needs to be 0.6 at. % or more, and is preferably 0.9 at. % or more. In this alloy, 0.6 at. % Ca corresponds to approximately 1% by mass, which is the lower limit at which flame retardancy appears in a similar magnesium alloy. When the content of Ca is less than this, flame retardancy becomes insufficient. When the alloy contains 0.9 at. % or more of Ca, sufficient flame retardancy can be secured and sufficient heat resistance can be secured. On the other hand, the content of Ca needs to be 1.7 at. % or less, and is preferably 1.5 at. % or less. When too much Ca is used, the elongation tends to decrease. When the content of Ca is 1.5 at. % or less, a balance between elongation and heat resistance is easily maintained, which is preferable.

In the magnesium alloy according to the present invention, the content of the rare earth element (RE) needs to be 0.02 at. % or more. The rare earth element is not particularly limited, and may be misch metal. RE forms an Al-RE compound with Al, and heat resistance can be improved. When RE is less than 0.02 at. %, this effect is not sufficiently exhibited and the heat resistance tends to be insufficient. On the other hand, the content of RE needs to be 0.36 at. % or less, is preferably 0.25 at. % or less, and more preferably 0.15 at % or less. When the amount of RE is too large, an Al-RE compound or an Al-RE-Mn compound becomes coarse, and reduction in the elongation is unignorable. When the content of RE is 0.25 at. % or less, the amount of RE compound is reduced and the decrease of elongation is easily suppressed while the effect of improving heat resistance is sufficiently maintained by the amount of Al-RE compound, and when the content of RE is 0.15 at. % or less, elongation is further easily secured, which is preferable.

The magnesium alloy according to the present invention needs to contain either one of Sn and Zn in addition to the above elements.

When the magnesium alloy according to the present invention contains Zn, the content of Zn needs to be 0.1 at. % or more, and is preferably 0.15 at. % or more. Zn contributes to castability and ductility, and an effect of Zn is sufficiently exhibited when the content of Zn is 0.15 at. % or more. On the other hand, the content of Zn needs to be 0.3 at. % or less, and is preferably 0.25 at. % or less. When the content of Zn is too large, crystals are formed, and not only the elongation decreases, but also hot tear may occur. When the content of Zn is 0.25 at. % or less, the balance between castability and elongation can be sufficiently secured.

On the other hand, when the magnesium alloy according to the present invention contains Sn, the content of Sn needs to be 0.02 at. % or more, and is preferably 0.04 at. % or more. Sn contributes to improvement of castability. When the content of Sn is 0.04 at. % or more, these effects are sufficiently exhibited. On the other hand, the Sn content needs to be 0.18 at. % or less, and is preferably 0.15 at. % or less. When the content of Sn is too large, crystallization of the Al—Ca compound is inhibited and a coarse Mg—Ca—Sn compound is formed, and reduction in the elongation is unignorable. When the content of Sn is 0.15 at % or less, the balance between heat resistance and elongation can be sufficiently secured.

It is not preferable to contain both Sn and Zn, and the content of the element which does not exert the effect needs to be less than the above-mentioned range, and is preferably less than the detection limit. This is because, if any of these elements is contained in the above range, adverse effects such as a decrease in heat resistance also increase synergistically.

In the magnesium alloy according to the present invention, the above conditions need to be satisfied, and the content of Al (at. %), the content of Ca (at. %), and the content of RE (at. %) need to satisfy the condition of the inequality of the following Formula (1). Both Ca and RE form a compound with Al, thereby suppressing creep elongation and forming a compound that improves heat resistance. However, when the content of Al is too large, $Mg_{17}Al_{12}$ which lowers heat resistance crystallizes out. In order to suppress the crystallization of $Mg_{17}Al_{12}$ and to effectively crystallize an Al—Ca compound or an Al-RE compound for improving heat resistance, the condition of the following Formula (1) needs to be satisfied. When the value of creep elongation fluctuates greatly before and after the boundary value, and the value on the left side of the formula exceeds 0.137, creep elongation is greatly suppressed.

$$(Ca+RE)/Al>0.137 \quad (1)$$

The magnesium alloy according to the present invention may contain inevitable impurities in addition to the above elements. These inevitable impurities are inevitably contained contrary to intention due to manufacturing problems or problems on raw materials. Examples thereof include an element such as Si, Fe, Ni, and Cu. The contents of inevitable impurities need to be in a range not inhibiting characteristics of the magnesium alloy according to the present invention, and the content per element is preferably less than 0.1 at. %. Inevitable impurities are preferably as small as possible, and it is particularly preferable that the content of inevitable impurities is less than the detection limit.

However, among the other elements, it is preferable that the content of Group 2 elements other than Ca and Mg, that is, Be, Sr, Ba, Ra is as small as possible. Specifically, the total amount of these elements is preferably less than 0.05 at. %, and each element is desirable less than the detection limit. This is because these Group 2 elements are expensive and cause cost increase.

The magnesium alloy according to the present invention can be prepared by a general method using raw materials containing the above elements so as to fall within the above range in terms of at. %. The above atomic ratio and at. % are the ratio and percentage in a prepared alloy or a product manufactured by casting the alloy, not the ratio and % in a raw material.

The magnesium alloy according to the present invention has high heat resistance, and a product manufactured using the magnesium alloy according to the present invention has favorable creep resistance under high temperature conditions. This is an easy-to-use alloy in terms of elongation and the like.

EXAMPLES

An example in which the magnesium alloy according to the present invention was actually prepared is shown. A magnesium alloy was prepared in such a manner that the contents of elements other than Mg were as indicated in Table I below in terms of at. %, and an alloy material having a thickness of 50 mm was produced by gravity casting. The inevitable impurities are all less than 0.01 at. %, and are omitted in the Table. Ce and La are contained as RE, and values obtained by extracting the contents of these elements are shown respectively.

TABLE 1

| | Composition [at. %] | | | | | | | | Evaluation results | | | | | | |
|---|---|---|---|---|---|---|---|---|---|---|---|---|---|---|---|
| | | | | RE | | | | | 0.2% proof | | Elongation | | Creep elongation | | (Ca + RE) |
| Sample No. | Al | Mn | Ca | | (Ce) | (La) | Zn | Sn | stress [MPa] | | [%] | | [%] | | Al |
| Example 1 | 6.29% | 0.12% | 1.00% | 0.11% | 0.04% | 0.07% | 0.20% | 0% | 85.8 | G | 1.8 | G | 0.09 | VG | 0.177 |
| Example 2 | 6.33% | 0.12% | 1.00% | 0.20% | 0.09% | 0.11% | 0.20% | 0% | 87.4 | G | 2.5 | G | 0.15 | G | 0.190 |
| Example 3 | 6.23% | 0.12% | 1.22% | 0.11% | 0.04% | 0.06% | 0.20% | 0% | 89.6 | G | 1.6 | G | 0.13 | VG | 0.213 |
| Example 4 | 6.23% | 0.12% | 1.25% | 0.20% | 0.09% | 0.11% | 0.20% | 0% | 86.7 | G | 1.5 | G | 0.16 | G | 0.232 |
| Example 5 | 7.28% | 0.10% | 1.21% | 0.11% | 0.04% | 0.07% | 0.20% | 0% | 94.9 | VG | 1.3 | G | 0.16 | G | 0.181 |
| Example 6 | 7.45% | 0.09% | 1.19% | 0.21% | 0.09% | 0.12% | 0.20% | 0% | 85.9 | G | 1.4 | G | 0.15 | G | 0.188 |
| Example 7 | 6.77% | 0.13% | 0.98% | 0.11% | 0.05% | 0.06% | 0% | 0.08% | 83.9 | G | 2.6 | G | 0.11 | VG | 0.162 |
| Example 8 | 6.81% | 0.14% | 1.02% | 0.16% | 0.07% | 0.09% | 0% | 0.06% | 83.6 | G | 1.9 | G | 0.15 | G | 0.174 |
| Example 9 | 6.95% | 0.13% | 1.25% | 0.11% | 0.05% | 0.06% | 0% | 0.06% | 87.6 | G | 1.8 | G | 0.08 | VG | 0.195 |
| Example 10 | 6.94% | 0.14% | 1.19% | 0.17% | 0.08% | 0.09% | 0% | 0.06% | 84.6 | G | 1.8 | G | 0.11 | VG | 0.196 |
| Example 11 | 7.40% | 0.11% | 1.22% | 0.11% | 0.04% | 0.06% | 0% | 0.06% | 85.5 | G | 1.4 | G | 0.12 | VG | 0.180 |
| Example 12 | 7.44% | 0.09% | 1.46% | 0.20% | 0.09% | 0.10% | 0% | 0.06% | 87.3 | G | 1.0 | G | 0.07 | VG | 0.222 |
| Comparative Example 1 | 6.61% | 0.09% | 0.83% | 0% | 0% | 0% | 0.29% | 0% | 92.1 | VG | 1.8 | G | 0.22 | B | 0.125 |
| Comparative Example 2 | 8.08% | 0.09% | 1.29% | 0% | 0% | 0% | 0.26% | 0% | 96.9 | VG | 1.0 | G | 0.21 | B | 0.160 |
| Comparative Example 3 | 6.55% | 0.11% | 1.71% | 0% | 0% | 0% | 0.26% | 0% | 105.7 | VG | 0.9 | B | | — | |
| Comparative Example 4 | 5.38% | 0.10% | 1.05% | 0% | 0% | 0% | 0% | 0% | 78.3 | B | 1.6 | G | | — | |
| Comparative Example 5 | 5.55% | 0.13% | 0.92% | 0.18% | 0.08% | 0.09% | 0% | 0.10% | 77.6 | B | 3.5 | G | | — | |
| Comparative Example 6 | 7.32% | 0.12% | 0.96% | 0.12% | 0.05% | 0.07% | 0.20% | 0% | 90.8 | VG | 1.4 | G | 0.24 | B | 0.148 |
| Comparative Example 7 | 7.47% | 0.09% | 0.95% | 0.21% | 0.10% | 0.12% | 0.20% | 0% | 89.6 | G | 1.8 | G | 0.24 | B | 0.155 |
| Comparative Example 8 | 8.67% | 0.17% | 1.36% | 0% | 0% | 0% | 0% | 0.38% | 105.1 | VG | 0.9 | B | | — | |
| Comparative Example 9 | 8.38% | 0.17% | 1.30% | 0% | 0% | 0% | 0% | 0.18% | 102.1 | VG | 2.0 | G | 0.19 | B | 0.155 |
| Comparative Example 10 | 5.36% | 0.17% | 1.16% | 0% | 0% | 0% | 0% | 0.10% | 76.9 | B | 3.6 | G | | — | |
| Comparative Example 11 | 8.18% | 0.10% | 0% | 0% | 0% | 0% | 0.28% | 0% | 94.5 | VG | 3.6 | G | (Broken) | B | 0.000 |
| Comparative Example 12 | 3.77% | 0.11% | 0% | 0.70% | 0.47% | 0.23% | 0% | 0% | 73.2 | B | 8.0 | G | 0.24 | B | 0.185 |
| Comparative Example 13 | 3.94% | 0.10% | 0% | 0.36% | 0.25% | 0.11% | 0% | 0% | 69.8 | B | 8.3 | G | 0.39 | B | 0.091 |

For each alloy, a test was conducted based on the tensile test method specified in JIS Z 2241 (ISO6892-1). A test specimen was produced by subjecting the above-described alloy material to machining, and the 0.2% proof stress: $R_{p0.2}$ was measured using Autograph (AG-Xplus-100 kN manufactured by Shimadzu Corporation) as a tester. As a result of the measurement, those having a 0.2% proof stress of 90 MPa or more were evaluated as "VG" (Very Good), those having a 0.2% proof stress of 80 MPa or more and less than 90 MPa as "G" (Good), and those having a 0.2% proof stress of less than 80 MPa as "B" (Bad). Based on the tensile test method also specified in JIS Z 2241, elongation: A was measured using the above-described tester. Those having an elongation of 1.0% or more were evaluated as "G", and those having an elongation of less than 1.0% were evaluated as "B".

Tests were conducted on Examples and some Comparative Examples based on the creep test method specified in JIS Z 2271 (ISO204). A test specimen was produced by machining the above-described alloy material, and the creep elongation: $A_f$ (%) after 100 hours passed was measured using a model number FC-13 manufactured by TAKES GROUP LTD. for a creep tester with the test temperature being 175° C. and the applied stress being 50 MPa. Those having a creep elongation of less than 0.15% were evaluated as "VG", those having a creep elongation of 0.15% or more and less than 0.18% as "G", and those having a creep elongation of 0.18% or more as "B".

Among them, Comparative Examples 1 and 2 are examples in which the heat resistance was insufficient since RE was not contained. Both of these have problems with creep elongation. Comparative Example 3 is an example in which RE was not contained and Ca was excessive. Comparative Example 3 is an example in which, despite being an advantageous composition for elongation due to not containing RE, elongation is deteriorated beyond the advantage due to excessive Ca. In Comparative Examples 4 and 5, the 0.2% proof stress deteriorated due to lack of Al. In Comparative Example 5 in which RE and Sn were added in Comparative Example 4, the 0.2% proof stress was not improved.

Comparative Examples 6 and 7 are examples in which ((Ca+RE)/Al) was below the limit value 0.137. Although the individual contents were values similar to those of Examples, when ((Ca+RE)/Al) was less than this limit value, the creep elongation exhibited an extremely deteriorating behavior. This unique behavior is shown in the graph of FIG. 1. Comparative Examples 6 and 7 are shown by two points where the creep elongation is 0.24 and the value of (Ca+RE)/Al is close to the line of 0.140.

Comparative Example 8 is an example in which a problem occurred in the elongation. Since RE was not contained, the elongation tended to be favorable, and the excessive Sn formed a partly coarse Mg—Ca—Sn compound, while the volume ratio of a networked Al—Ca compound decreased somewhat, and therefore, these effects were canceled, and contribution to elongation was small. Nevertheless, the elongation was greatly reduced due to excess Al. Compared with this, in Comparative Example 9, since the amount of Al was small, the elongation was favorable. It is noted that, in Comparative Example 9, since RE was not contained, there was a problem with creep elongation.

On the other hand, in Comparative Example 10 in which the amount of Al was too small, it was shown that there was a problem with 0.2% proof stress. Further, in Comparative Example 11 in which Ca was not contained, the test specimen broke in the test of creep elongation. In Comparative Example 12, although the condition of (Ca+RE)/Al) was satisfied, when Ca was deficient, it was also shown that there was a problem with creep elongation. In both Comparative Examples 12 and 13, Al was deficient, and there was also a problem with 0.2% proof stress.

The invention claimed is:

1. A magnesium alloy comprising, in atomic percent:
5.7 at. % or more and 8.6 at. % or less of Al;
0.6 at. % or more and 1.5 at. % or less of Ca;
0.05 at. % or more and 0.27 at. % or less of Mn;
0.02 at. % or more and 0.15 at. % or less of La and/or Ce;
any one of 0.1 at. % or more and 0.3 at. % or less of Zn and 0.02 at. % or more and 0.18 at. % or less of Sn,
wherein the contents in atomic percent satisfy the condition of the inequality of the following Formula (1)

$$(Ca+(La \text{ and/or } Ce))/Al \geq 0.162 \quad (1); \text{ and}$$

a balance of Mg and inevitable impurities.

2. The magnesium alloy according to claim 1, comprising:
6.2 at. % or more and 7.5 at. % or less of Al;
0.9 at. % or more and 1.5 at. % or less of Ca;
0.05 at. % or more and 0.20 at. % or less of Mn;
0.06 at. % or more and 0.15 at. % or less of La and/or Ce; and
any one of 0.15 at. % or more and 0.25 at. % or less of Zn and 0.04 at. % or more and 0.15 at. % or less of Sn.

3. The magnesium alloy according to claim 1, comprising 0.02 at. % or more and 0.15 at. % or less of La and Ce.

4. The magnesium alloy according to claim 2, comprising 0.06 at. % or more and 0.15 at. % or less of La and Ce.

* * * * *